United States Patent [19]

Zacharias

[11] 4,404,884

[45] Sep. 20, 1983

[54] STRINGED INSTRUMENT WITH KEYBOARD, OF THE CLAVICHORD TYPE

[75] Inventor: Ernst Zacharias, Trossingen, Fed. Rep. of Germany

[73] Assignee: Matth. Hohner AG, Trossingen, Fed. Rep. of Germany

[21] Appl. No.: 247,798

[22] Filed: Mar. 26, 1981

[51] Int. Cl.[3] ..... G10C 3/18

[52] U.S. Cl. ..... 84/258; 84/1.16

[58] Field of Search ..... 84/173, 234, 247, 258, 84/1.15, 1.16

[56] References Cited

U.S. PATENT DOCUMENTS 1,750,572 3/1930 Cloetens ..... 84/173
2,568,862 9/1951 Martin ..... 84/1.16
3,447,410 6/1969 Zacharias ..... 84/247

FOREIGN PATENT DOCUMENTS 339690 12/1930 United Kingdom ..... 84/173
1434252 5/1976 United Kingdom ..... 84/258

*Primary Examiner*—Lawrence R. Franklin

[57] ABSTRACT

Stringed instruments of the clavichord type, wherein playing key operated tangent cooperate with a fixed stop to both sound and stop associated strings without the noise associated with the tangent impacting the stop. This noise elimination is accomplished by providing that the tangent is offset from the respective stop, such that a free string portion exists between the opposing stop and the tangent.

4 Claims, 1 Drawing Figure

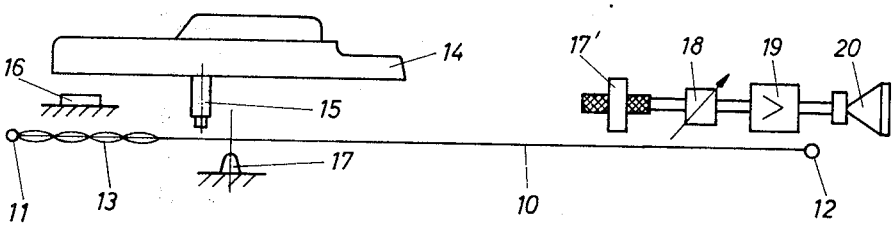
14
16
15
17
17'
18
19
20
11
13
10
12

STRINGED INSTRUMENT WITH KEYBOARD, OF THE CLAVICHORD TYPE

BACKGROUND OF THE INVENTION

1. Field of the Invention

The present invention relates to string keyboard instruments and particularly to improvements in clavichords. More specifically, this invention is directed to enhancing the performance of keyboard instruments of the type in which sound is generated by contact between a moveable member and a stretched string and particularly to reduction of the unwanted sound resulting from the physical contact between said member and other elements of the instrument. Accordingly, the general objects of the present invention are to provide novel and improved apparatus and methods of such character.

2. Description of the Prior Art

The present invention is particularly well suited for use in clavichords.

A clavichord is a keyboard instrument wherein the pressing of a key causes a tangent to strike a string and set it into vibration. The pitch is not determined by the total string length, but by the point of contact between the tangent and string which separates the string into two independently vibrating portions, one of which is silenced by means of a mute. This type of instrument is capable of producing only a limited volume of sound and requires means for providing electronic amplification.

A stringed instrument of the clavichord type is shown in German Patent application Ser. No. 1,273,964. The instrument disclosed in this German patent application has the tangent lying opposite a fixed anvil, so that upon pressing the key, the string becomes clamped between the tangent and anvil. Thus the tangent strikes the anvil together with the string, and gives rise to a knocking sound. This knocking sound is electronically amplified by a sound pickup. Attempts to eliminate this knocking sound through the use of tangents constructed of various plastics, which allow a relatively soft engagement between the tangent and anvil, have failed to completely eliminate the undesirable noise.

SUMMARY OF THE PRESENT INVENTION

The present invention overcomes the above briefly discussed and other deficiencies and disadvantages of the prior art and, in so doing, provides a novel and improved keyboard instrument of the clavichord type. Specifically, the present invention improves the sound of a stringed instrument of the clavichord type by providing an instrument in which noises due to the striking of the tangent and string against an opposing stop are substantially eliminated.

In accordance with the present invention, a stringed instrument having a keyboard, of the clavichord type, is provided with respective playing keys carrying a tangent which, when the key is activated, presses an associated string. The string cooperates with a fixed stop and will include a mute on one end portion thereof. In accordance with a particularly novel feature of this invention, the impact point of the tangent on the spring is offset towards the muted string portion from the opposing stop. Accordingly, a free string portion exists between the opposing stop and the tangent. In accordance with the preferred embodiment, the stop is in the form of a cross-piece.

In use of an instrument in accordance with the preferred embodiment, the tangent will impact against the string and force the string downwardly so that it contacts the opposing stop. The small portion of the string disposed between the point of contact with the tangent and the opposing stop is sufficiently resilient to absorb the impact and thus no disturbing impact will be generated and subsequently sensed and amplified. As an additional advantage resulting from the use of the present invention an improved vibration efficiency is attained and the variation in volume obtainable through key manipulation is enhanced.

It is to be noted that the aforementioned German application No. 1,273,964 shows an instrument wherein the tangent is offset slightly from the highest point on the opposite stop or anvil in the direction of the muted string portion. However, in the instrument of the aforementioned German application, and as is characteristic of the prior art, the string is still clamped between the tangent and anvil upon activation of the key. Thus the offsetting of the tangent serves only to vary the pitch, in the manner of a vibrator, since the string is clamped against the anvil in a region adjacent to but offset from the ridge of the anvil. However, according to the invention the string is not clamped between the anvil or stop and the tangent but rather is impacted upon by the tangent at a distance from the fixed opposing stop. Accordingly, in an instrument in accordance with the present invention an anvil with an associated stop surface is not required and, the opposing stop for the string may be in the form of a cross-piece.

BRIEF DESCRIPTION OF THE DRAWING

The present invention may be better understood and its numerous objects and advantages will become apparent to those skilled in the art by reference to the accompanying drawing which is a schematic illustration of a single string and the activating mechanism therefore in accordance with the preferred embodiment of the present invention.

DESCRIPTION OF THE PREFERRED EMBODIMENT

A string 10 extends between anchoring points 11 and 12. String 10 is muted at a first end portion by means of a mute 13 which may comprise wool fibers or pieces of felt interwoven over the string 10. The string 10 will be set into vibration, to produce the desired musical tone, by means of a manually operable key 14 which includes a tangent 15. Tangent 15 will be positioned above and in alignment with the string 10. A fixed stop 16, substantially in the form of a key felt piece, is associated with the key 14 in order to limit the stroke of the key 14. The impact of the key 14 on the stop 16 is the only mechanical noise which will be generated and this noise, which is proportionally no greater than in the case of grand or upright piano, will not be amplified.

A fixed cross-piece 17 is disposed below the string 10 in a position offset with respect to the tangent 15. The pitch produced by the striking of tangent 15 against string 10 is determined by the distance between the point of contact between string 10 and cross-piece 17 and the anchoring point 12. The vibrations of the string 10 are sensed by a sound pickup 17' and the electrical signals transduced by pick-up 17' are delivered by a controller 18 and amplifier 19 to a loudspeaker 20.

On pressing the key 14, the tangent 15 will engage the string 10 in the region thereof which includes the muted string portion at a distance displaced toward anchoring point 11 from the cross-piece 17. Accordingly, a free string portion exists between the tangent 15 and cross-piece 17 and thus no disturbing impact noises are produced and amplified. The distance between the tangent 15 and cross-piece 17, and thus the length of the free string portion therebetween, will typically be on the order of a few millimeters.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a stringed instrument of the clavichord type employing a plurality of stretched strings, wherein each key carries a tangent which may be caused to impact against a single associated string by actuation of the key, the impact of the tangent causing the string to vibrate, each string also corresponding with a fixed stop disposed at the side of the string opposite to the tangents, the strings each also having associated therewith muting devices positioned adjacent first ends of the strings, the improvement comprising:

means positioning the key tangents at points along the individual associated strings which are off-set with respect to the point of contact between the string and stop toward the muting devices whereby a free string portion is established between each tangent and the said point of contact of its associated string with a stop.

2. The instrument of claim 1 wherein the stop is in the form of a cross-piece.

3. The instrument of claim 2 wherein the cross-piece is contacted by a plurality of strings.

4. A method of improving the performance of a clavichord type stringed instrument comprising:

establishing a free portion of each string between the individual associated key operated member which impacts the said string and the fixed member which contacts the said string subsequent to impact, the strings having muting devices associated therewith and the free string portions being at the same side of the fixed member as the muting devices.

* * * * *